US008537102B2

(12) United States Patent
Li et al.

(10) Patent No.: US 8,537,102 B2
(45) Date of Patent: Sep. 17, 2013

(54) BACKLIGHT CONTROL APPARATUS AND CONTROL METHOD THEREOF

(75) Inventors: Chung-Jian Li, Hsinchu County (TW); Tzung-Yuan Lee, Taichung County (TW); Chia-Hsin Tung, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 230 days.

(21) Appl. No.: 13/018,403

(22) Filed: Jan. 31, 2011

(65) Prior Publication Data

US 2011/0187760 A1 Aug. 4, 2011

(30) Foreign Application Priority Data

Feb. 2, 2010 (TW) ..... 99103026 A

(51) Int. Cl.
*G09G 3/36* (2006.01)

(52) U.S. Cl.
USPC ..... 345/104

(58) Field of Classification Search
USPC ..... 345/690
See application file for complete search history.

(56) References Cited

U.S. PATENT DOCUMENTS

| | | | | |
|---|---|---|---|---|
| 6,839,048 | B2 * | 1/2005 | Park | 345/102 |
| 2002/0067332 | A1 * | 6/2002 | Hirakata et al. | 345/102 |
| 2006/0146005 | A1 * | 7/2006 | Baba et al. | 345/102 |
| 2007/0103424 | A1 * | 5/2007 | Huang | 345/102 |
| 2007/0279369 | A1 * | 12/2007 | Yao et al. | 345/102 |

FOREIGN PATENT DOCUMENTS

| | | |
|---|---|---|
| CN | 1400576 | 3/2003 |
| CN | 101131505 | 2/2008 |
| CN | 101540135 | 9/2009 |
| JP | 2006098765 | 4/2006 |

OTHER PUBLICATIONS

"First Office Action of China counterpart application" issued on Aug. 2, 2012, p. 1-p. 8.
"Second Office Action of China Counterpart Application", issued on Mar. 20, 2013, p. 1-p. 5.

* cited by examiner

*Primary Examiner* — Dorothy Harris
(74) *Attorney, Agent, or Firm* — Jianq Chyun IP Office

(57) ABSTRACT

A backlight control apparatus for controlling luminance of a backlight panel includes an image information memory and a detection and automatic switching circuit. The image information memory is for storing the image information. The detection and automatic switching circuit is for detecting the updated frequency of the updated image information and then sets a displaying mode for adjusting the luminance of the backlight panel according to the updated frequency.

4 Claims, 5 Drawing Sheets

BACKLIGHT CONTROL APPARATUS AND CONTROL METHOD THEREOF

CROSS-REFERENCE TO RELATED APPLICATION

This application claims the priority benefit of Taiwan application serial no. 99103026, filed on Feb. 2, 2010. The entirety of the above-mentioned patent application is hereby incorporated by reference herein and made a part of this specification.

BACKGROUND OF THE INVENTION

1. Field of the Invention

The present invention generally relates to a backlight control apparatus and the control method thereof, and more particularly, to a backlight control apparatus and a backlight control method of a backlight panel of a display panel.

2. Description of Related Art

In a display apparatus with passively light-emitting (for example, a liquid crystal display apparatus, i.e., LCD apparatus), it's a well known technique to deploy a backlight panel serving as the light-emitting source thereof. Along with the durably increasing demand of users on the display quality of a display apparatus, now the backlight panel is not meant to provide a pure light source only. In fact, the luminance of a modern backlight panel needs to be adjusted depending on different display conditions and the electrical consumption, so that the efficiency of the display apparatus can be effectively advanced.

In this regard, a recently launched content adaptive backlight control (CABC) technique is a technical effort, where the content of displayed image is used to adjust the luminance of backlight panel. The CABC technique is used to correspondingly adjust the luminance of backlight panel according to different frame modes of a display apparatus, i.e., according to a static frame mode or a dynamic frame mode. Adopting the CABC scheme makes a display apparatus have the optimal display effect under the most effective power management to achieve the minimum power consumption. However, in the conventional CABC embodiments, during switching the luminance of backlight panel, due to an incorrect switching time-point, the displayed frame of the display apparatus produces flashing phenomena so as to downgrade the display quality.

SUMMARY OF THE INVENTION

Accordingly, the present invention is directed to a backlight control apparatus and the control method thereof for automatically judging an image displayed by a display panel is a dynamic image or a static image and thereby adjusting the luminance of the backlight panel.

The present invention provides a backlight control apparatus for controlling the luminance of the backlight panel. The backlight control apparatus includes an image information memory and a detection and automatic switching circuit. The image information memory is for storing the image information. The detection and automatic switching circuit is coupled to the image information memory for detecting the updated frequency of the updated image information and then sets a displaying mode for adjusting the luminance of the backlight panel according to the updated frequency.

In an embodiment of the present invention, the above-mentioned detection and automatic switching circuit includes a detection counter and a mode switch, wherein the detection counter detects the updated status of the image information every a predetermined time period and further changes a counting result according to the updated status. The mode switch is coupled to the detection counter for setting the displaying model as an animated model or a static model according to the counting result.

In an embodiment of the present invention, when the above-mentioned detection counter detects out the image information is not updated yet within a predetermined time, the counting result is descended; when the detection counter detects out the image information is updated already within a predetermined time, the counting result is ascended.

In an embodiment of the present invention, when the counting result is greater than or equal to an upper limit value, the above-mentioned mode switch switches the displaying model to the animated model; when the counting result is less than or equal to a lower limit value, the above-mentioned mode switch switches the displaying model to the static model.

The present invention further provides a backlight control method for controlling the luminance of the backlight panel. The method includes: detecting the updated frequency of the image information stored in an image information memory; setting a displaying mode for adjusting the luminance of the backlight panel according to the updated frequency.

Based on the depiction above, the present invention detects the updated frequency of the image information stored in the image information memory and thereby judges whether the image displayed by the display panel is a dynamic image or a static image so as to accordingly set the displaying mode. Then, the set displaying mode is used to adjust the luminance of the backlight panel so that the optimal switching time-point for the luminance of the backlight panel can be obtained.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
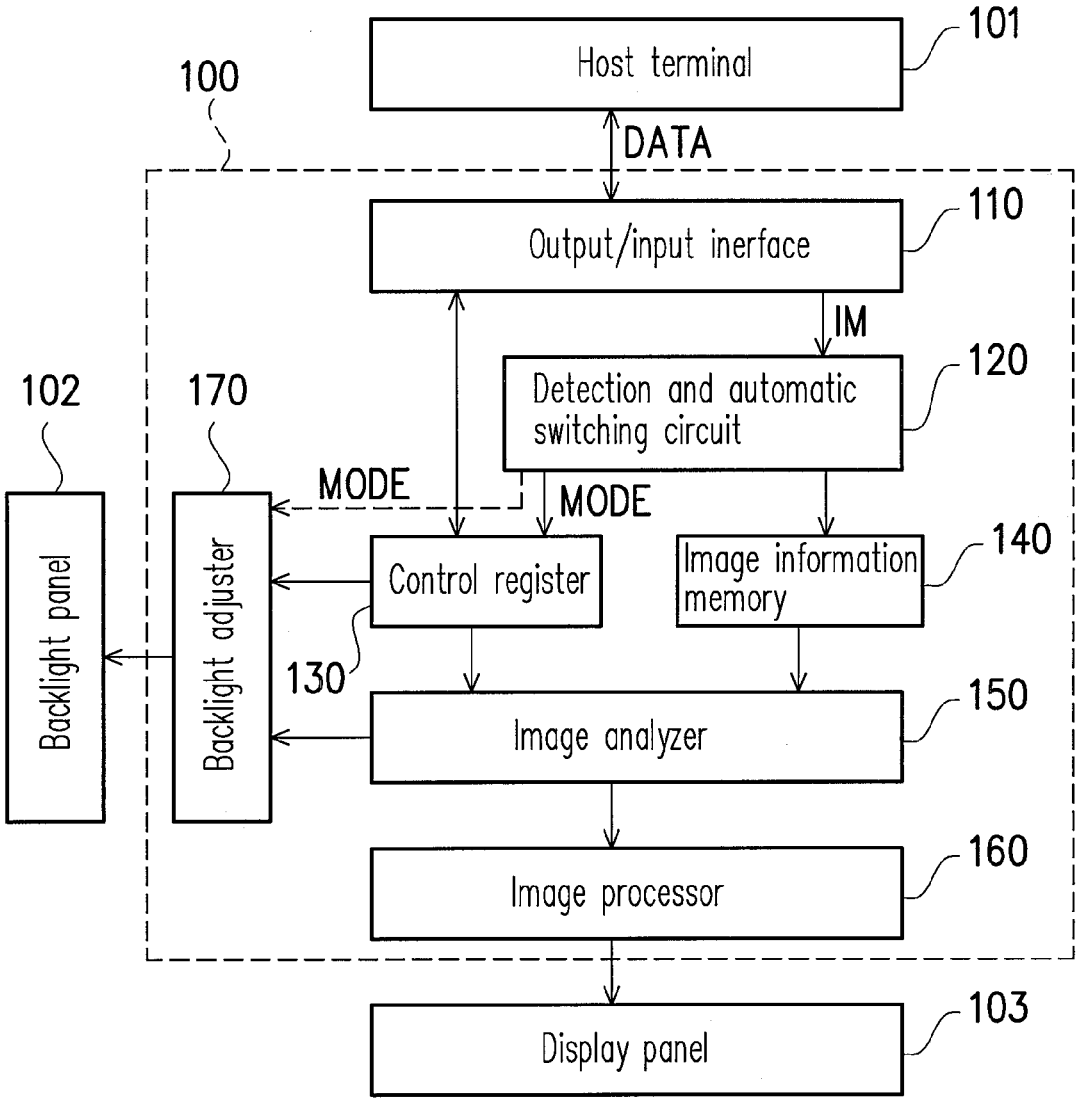
FIG. 1 is a diagram of a backlight control apparatus 100 according to an embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a diagram of a backlight control apparatus 100 according to an embodiment of the present invention. Referring to FIG. 1, the backlight control apparatus 100 is for controlling the luminance of a backlight panel 102. The backlight control apparatus 100 includes an output/input interface 110, a detection and automatic switching circuit 120, a control register 130, an image information memory 140, an image analyzer 150, an image processor 160 and a backlight adjuster 170. The output/input interface 110 receives a information DATA come from a host terminal 101 and transmits the information DATA respectively to the control register 130 and the detection and automatic switching circuit 120, wherein the information DATA sent by the host terminal 101 usually includes an image information IM provided to the display panel and a control command for controlling the operation of the backlight control apparatus 100. The image information IM is transmitted to the image information memory 140 through the detection and automatic switching circuit 120 for storing and the control command is transmitted to the control register 130 for being registered.

Since the image information IM is saved in the image information memory 140 through the detection and automatic switching circuit 120, so that the detection and automatic switching circuit 120 is able to know the updated status of the image information IM in the image information memory 140 and further obtain the updated frequency of the image information IM. In short, the detection and automatic switching circuit 120 records the counting number for the image information IM in the image information memory 140 to be updated within a certain predetermined time period (i.e., accumulating the new counting number for the image information IM to be transmitted to the detection and automatic switching circuit 120 within the predetermined time period) so as to obtain the updated frequency of the updated image information IM.

It should be noted that when the display panel 103 displays static frames, the image information IM is not durably to be necessarily updated, instead, the image information IM is updated only within a longer time period. In contrast, when the display panel 103 displays dynamic frames, the display panel 103 continuously displays a plurality of different images so that the image information IM is durably updated. In other words, when the detection and automatic switching circuit 120 detects out the updated frequency of the image information IM in the image information memory 140 is higher, it can be concluded that the display panel 103 is displaying dynamic frames and thereby the displaying mode MODE is set as the animated model. In contrast, when the detection and automatic switching circuit 120 detects out the updated frequency of the image information IM in the image information memory 140 is lower, it can be concluded that the display panel 103 is displaying static frames and thereby the displaying mode MODE is set as the static model.

In addition, the above-mentioned judgment about a higher or lower updated frequency can be implemented by setting a threshold value. Whenever the updated frequency is greater than the threshold value, the updated frequency is judged as a higher one, and whenever the updated frequency is not greater than the threshold value, the updated frequency is judged as a lower one.

The detection and automatic switching circuit 120 transmits the set displaying mode MODE to the control register 130 and further to the backlight adjuster 170 through the control register 130, where the backlight adjuster 170 adjusts the luminance of the backlight panel 102 according to the received displaying mode MODE. In general speaking, when the displaying mode MODE received by the backlight adjuster 170 is the animated mode, the luminance of the backlight panel 102 is adjusted down; when the displaying mode MODE received by the backlight adjuster 170 is the static mode, the luminance of the backlight panel 102 is adjusted up.

It should be noted that the displaying mode MODE set by the detection and automatic switching circuit 120 can also be directly transmitted to the backlight adjuster 170 to make the backlight adjuster 170 adjust the luminance of the backlight panel 102 accordingly. The reason to mention the displaying mode MODE in the embodiment is transmitted to the backlight adjuster 170 through the control register 130 rests with that the user or the designer can also send out a control command through the host terminal 101 for adjusting the luminance of the backlight panel 102. As a result, the control register 130 is able to integrate the commands of adjusting the luminance of the backlight panel 102 come from two different sources (one is the displaying mode MODE and another is the control command sent out by the host terminal 101), so that an appropriate command can reach the backlight adjuster 170 for adjusting the optimal luminance of the backlight panel 102.

For example, when the control register 130 simultaneously receives the commands of adjusting the luminance of the backlight panel respectively come both from the detection and automatic switching circuit 120 and the host terminal 101, the luminance of the backlight panel 102 specified by the host terminal 101 serves as the base to adjust the luminance, wherein for example, when the displaying mode MODE is the static mode, the luminance of the backlight panel 102 specified by the user is used as the luminance of the backlight panel 102 and when the displaying mode MODE is the animated mode, the luminance of the backlight panel 102 specified by the user must be multiplied by a factor less than 1 (for example, 80%) and the result is used as the luminance of the backlight panel 102.

Figure 1A:
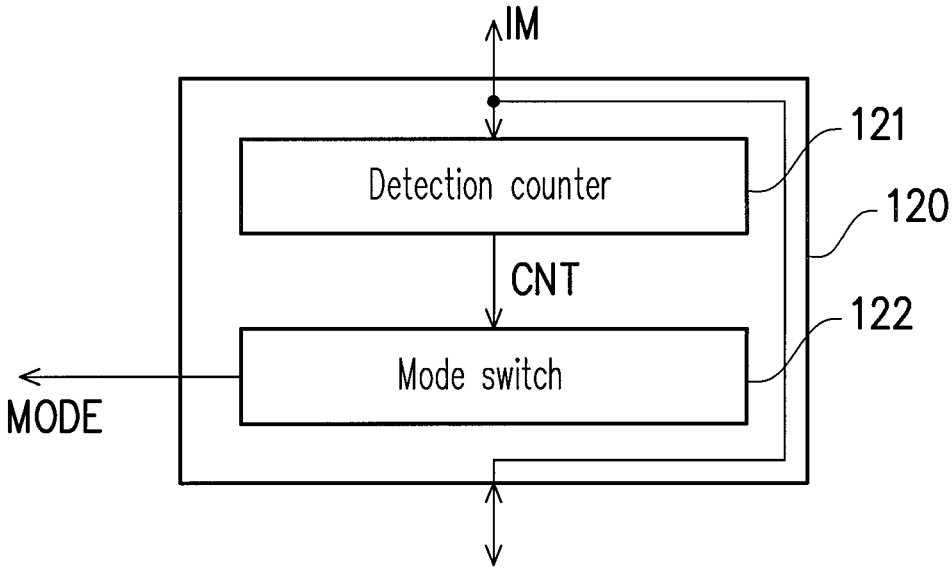
FIG. 1A is an implement diagram of a detection and automatic switching circuit 120 according to an embodiment of the present invention.

FIG. 1A is an implement diagram of a detection and automatic switching circuit 120 according to an embodiment of the present invention. Referring to FIG. 1A, in the embodiment, the detection and automatic switching circuit 120 includes a detection counter 121 and a mode switch 122. The detection counter 121 is for detecting the updated status of the image information IM every a predetermined time period and then changing and producing the counting result CNT according to the detected updated status. The mode switch 122 is coupled to the detection counter 121 for setting the displaying mode MODE as an animated model or a static model according to the counting result CNT.

To depict the detection way of the updated frequency of the image information IM and the setting method of the displaying mode in the embodiment of the present invention more clearly, another embodiment is explained in following, so that anyone skilled in the art can better understand the unique feature of the present invention.

Figure 2A:
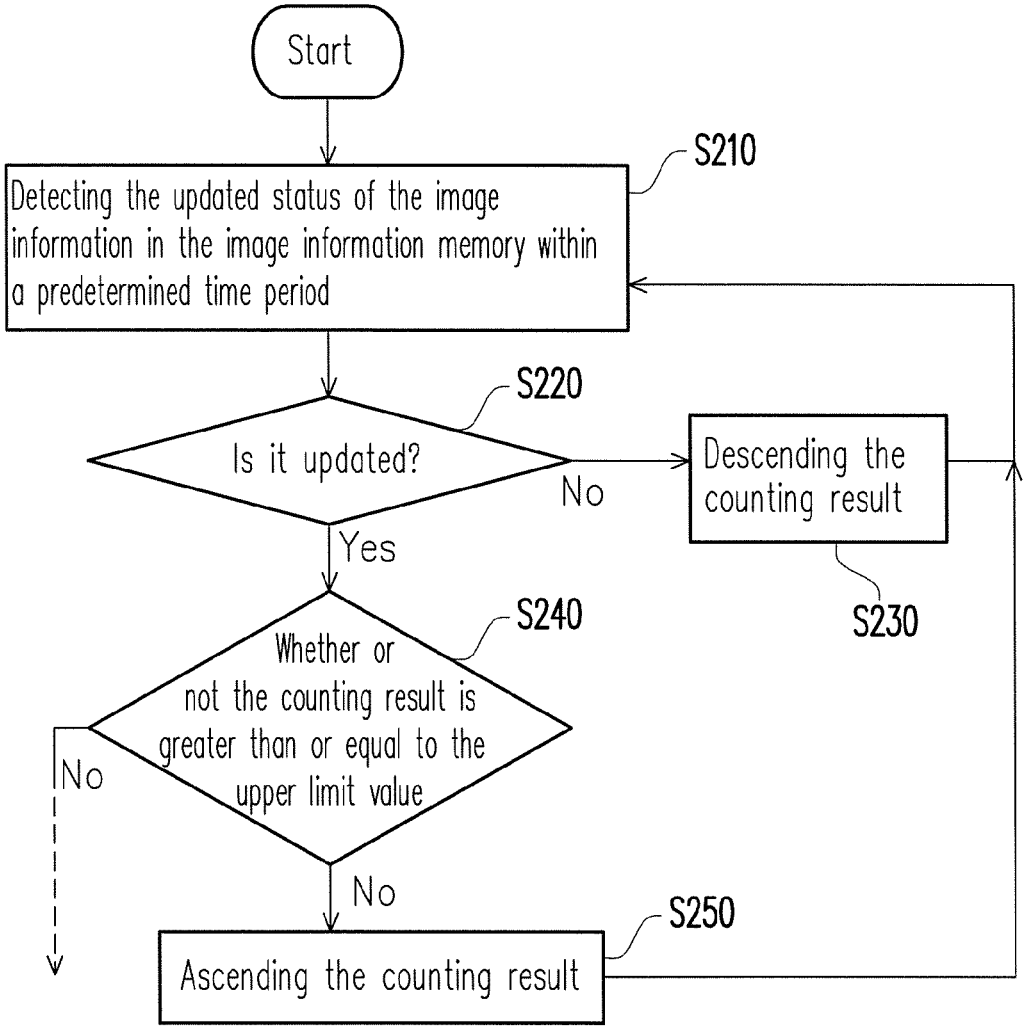
FIGS. 2A and 2B are operation flowcharts of the detection and automatic switching circuit according to the differences of the gray levels of a plurality of pixels corresponding to a same display position between the present frame information and the last frame information.
Figure 2B:
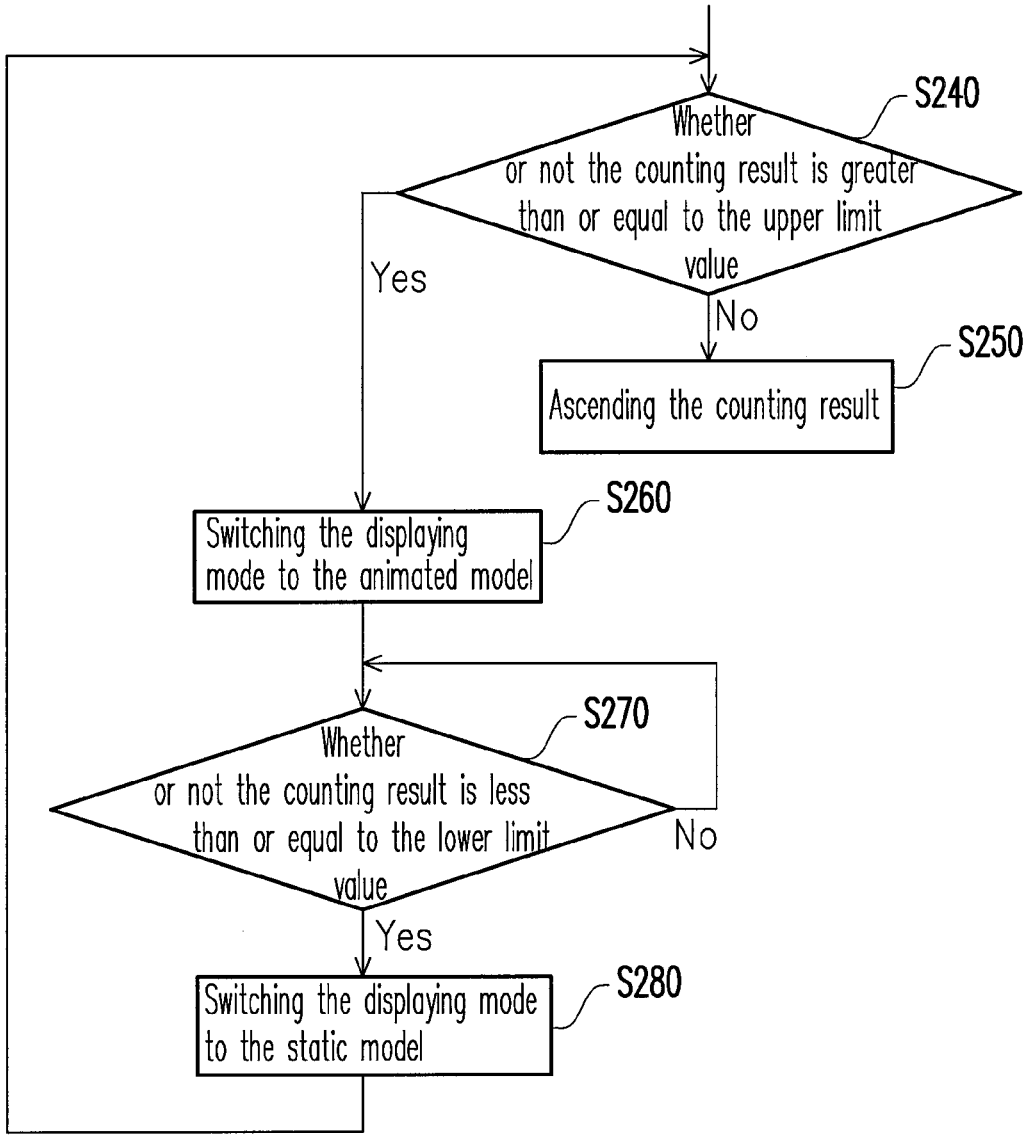

FIGS. 2A and 2B are operation flowcharts of the detection and automatic switching circuit according to the differences of the gray levels of a plurality of pixels corresponding to a same display position between the present frame information and the last frame information. Referring to FIG. 2A, firstly, the detection and automatic switching circuit 120 detects the updated status of the image information in the image information memory 140 within a predetermined time period (step S210), which means the detection task includes whether or not the image information memory 140 has a writing action within the predetermined time period or furthermore whether or not the image information in the image information memory 140 gets changed within the predetermined time period. In particular, in step S210, the updated counting number of the image information within the predetermined time period is ignored, but only the event whether or not the image information is updated is logged.

The detection and automatic switching circuit 120 further judges whether or not the image information is updated within the predetermined time period (step S220). If the detection and automatic switching circuit 120 judges out the image information is not updated within the predetermined time period, the counting result is descended (step S230), followed by executing step S210 again. On the other hand, if the detection and automatic switching circuit 120 judges out the image information is updated within the predetermined time period, the detection and automatic switching circuit 120 further judges whether or not the counting result is greater than or equal to the predetermined upper limit value (step S240). At the time, if the detection and automatic switching circuit 120 judges out the counting result is less than the upper limit value, the counting result is ascended. During executing steps S220 and S230, the detection and automatic switching circuit 120 keeps detecting whether or not the counting result is less than or equal to the predetermined lower limit value (step S270). Once the detected counting result is less than or equal to the predetermined lower limit value, the detection and automatic switching circuit 120 switches the displaying mode to the static model (step S280).

Referring to FIG. 2B, steps S240 and S250 in FIG. 2B are the same as steps S240 and S250 in FIG. 2A and herein they are repeated for better showing only. When step S240 judges out the counting result is greater than the predetermined upper limit value, the detection and automatic switching circuit 120 switches the displaying mode to the animated model (step S260).

When the detection and automatic switching circuit 120 judges out the counting result is greater than or equal to the upper limit value and the displaying mode has been switched to the animated model, the counting number is stopped to be ascended. In contrast, when the detection and automatic switching circuit 120 judges out the counting result is less than or equal to the lower limit value and the displaying mode has been switched to the static model, the counting number is stopped to be descended. In this way, the present invention can effectively avoid overflow or underflow phenomena of the counting number value.

Referring to FIGS. 1, 2A and 2B, the operation flow of the detection and automatic switching circuit 120 can also prevent switching the displaying mode MODE immediately after the detection and automatic switching circuit 120 detects out an excessive updated frequency of the image information IM in the image information memory 140. In this way, the detection and automatic switching circuit 120 of the embodiment can effectively avoid continuously switching the displaying mode MODE sourced by the host terminal 101 which non-uniformly writes the image information into the image information memory 140 under a limited bandwidth condition with the image information memory 140.

Figure 3:
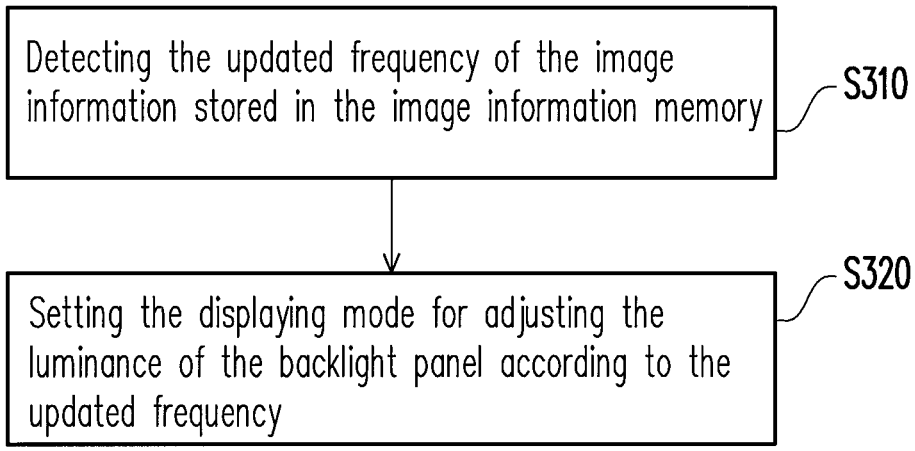
FIG. 3 is a flowchart of a backlight control method according to an embodiment of the present invention.

FIG. 3 is a flowchart of a backlight control method according to an embodiment of the present invention. Referring to FIG. 3, the steps include: firstly, detecting the updated frequency of the image information stored in the image information memory (step S310); next, setting the displaying mode for adjusting the luminance of the backlight panel according to the updated frequency (step S320). The detection of the updated frequency and the switching operation of the displaying mode are depicted in details in the above-mentioned embodiment of the backlight control apparatus 100, so that they are omitted to describe.

In summary, the present invention detects the updated frequency of the image information in the image information memory to judge the displayed image by the display panel is a dynamic image or a static image. Thereby, the displaying mode is set accordingly so as to dynamically adjust the luminance of the backlight panel. The present invention is advantageous in saving the electric consumption of the backlight panel and considering to keep good display quality.

It will be apparent to those skilled in the art that the descriptions above are several preferred embodiments of the present invention only, which does not limit the implementing range of the present invention. Various modifications and variations can be made to the structure of the present invention without departing from the scope or spirit of the invention.

What is claimed is:

1. A backlight control apparatus, for controlling the luminance of a backlight panel and comprising:

an image information memory, for storing an image information; and a detection and automatic switching circuit, coupled to the image information memory for detecting an updated frequency of the updated image information, wherein the detection and automatic switching circuit sets a displaying mode for adjusting the luminance of the backlight panel according to the updated frequency, wherein the detection and automatic switching circuit comprises:

a detection counter, detecting the updated status of the image information every a predetermined time period and further changing a counting result according to the updated status; and a mode switch, coupled to the detection counter for setting the displaying model as an animated model or a static model according to the counting result, wherein when the detection counter detects that the image information is not updated yet within a predetermined time, the counting result is descended; when the detection counter detects that the image information is updated already within a predetermined time, the counting result is ascended.

2. The backlight control apparatus as claimed in claim 1, wherein when the counting result is greater than or equal to an upper limit value, the mode switch switches the displaying model to the animated model; when the counting result is less than or equal to a lower limit value, the mode switch switches the displaying model to the static model.

3. A backlight control method, for controlling the luminance of a backlight panel and comprising:

detecting an updated frequency of an image information stored in an image information memory, and the updated frequency is detected by detecting the updated status of the image information every a predetermined time period and further changing a counting result according to the updated status; and setting a displaying mode as an animated mode or a static mode for adjusting the luminance of the backlight panel according to the updated frequency, wherein when the detection counter detects that the image information is not updated yet within the predetermined time, the counting result is descended; when the detection counter detects that the image information is updated already within the predetermined time, the counting result is ascended.

4. The backlight control method as claimed in claim 3, wherein the step "setting the displaying mode as the animated mode or the static mode according to the updated frequency" comprises:

when the counting result is greater than or equal to an upper limit value, the displaying model is switched to the animated model; and when the counting result is less than or equal to a lower limit value, the displaying model is switched to the static model.

* * * * *